United States Patent [19]

Nakazeki et al.

[11] 4,184,465

[45] Jan. 22, 1980

[54] FUEL INJECTION DEVICE FOR INTERNAL COMBUSTION ENGINES

[75] Inventors: Tugito Nakazeki, Iwata; Kei Kimata, Aichi; Syoichi Fukunaga, Iwata; Takashi Kuroiwa, Iwata; Seiji Morii, Iwata, all of Japan

[73] Assignee: NTN Toyo Bearing Co., Ltd., Osaka, Japan

[21] Appl. No.: 803,315

[22] Filed: Jun. 3, 1977

[30] Foreign Application Priority Data

Jun. 3, 1976 [JP] Japan ..... 51/65193

[51] Int. Cl.[2] ..... F02M 39/00

[52] U.S. Cl. ..... 123/139 AW; 123/139 BG

[58] Field of Search ..... 123/139 AW, 139 BC, 123/139 AL, 139 BG

[56] References Cited

U.S. PATENT DOCUMENTS

| | | | |
|---|---|---|---|
| 3,996,910 | 12/1976 | Noguchi et al. | 123/139 AW |
| 4,040,405 | 8/1977 | Tanaka et al. | 123/139 AW |
| 4,050,431 | 9/1977 | Jackson | 123/139 AW |

*Primary Examiner*—Charles T. Jordan

*Attorney, Agent, or Firm*—Armstrong, Nikaido, Marmelstein & Kubovcik

[57] ABSTRACT

A fuel injection device is disposed in a fuel supply passageway and adapted to control the amount of injection by controlling the opening time and/or opening area of a gate controlled in connection with engine rpm and the amount of suction air. The difference between the fuel supply pressure and the negative pressure in a suction pipe is maintained constant by a pressure regulator. The device contains a mechanism for compensating fuel supply pressure according to fuel temperature.

7 Claims, 8 Drawing Figures

Fig 2
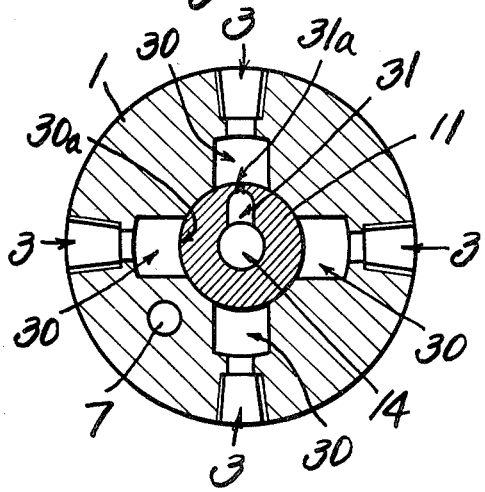
Fig 3-a
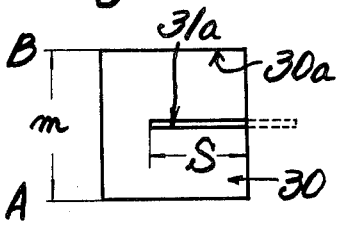
Fig 3-b
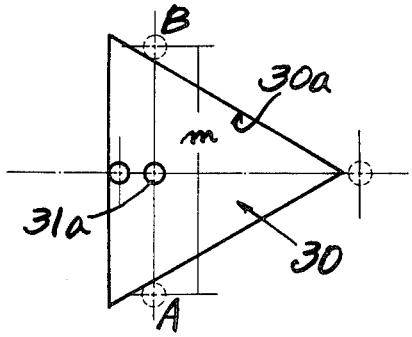
Fig 4
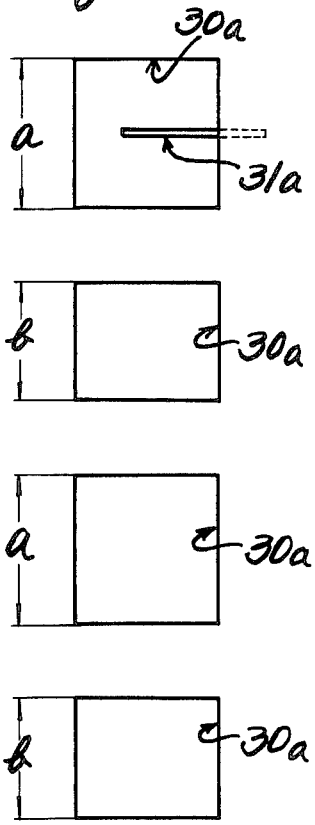

FUEL INJECTION DEVICE FOR INTERNAL COMBUSTION ENGINES

BACKGROUND OF THE INVENTION (a) Field of the Invention

The present invention relates to a fuel injection device and more particularly it relates to a fuel injection device of the type which intermittently injects fuel into the suction pipe of an internal combustion engine. More particularly, the invention relates to a fuel injection device of the type in which the amount of communication of fuel metering gate means disposed in a fuel supply passageway is controlled by engine rpm and the amount of air sucked into the engine.

(b) Description of the Prior Art

A fuel injection device of the type in which the amount of communication of fuel metering gate means disposed in a fuel supply passageway is controlled by engine rpm and the amount of air sucked into the engine is known.

In this known fuel injection device, there is provided a constant depression device for maintaining constant the pressure difference across the fuel metering gate, so as to assure that the amount of communication of the fuel metering gate means is proportional to the amount of fuel.

This type of fuel injection device, when used in a multicylinder internal combustion engine, however, includes a constant depression device for each channel, so that the construction is complicated. Another disadvantage is that if the response of the constant depression device is slow, the fuel metering accuracy is decreased.

SUMMARY OF THE INVENTION

The present invention relates to a fuel injection device comprising a fuel metering mechanism having a fuel supply port, a plurality of distributing ports and fuel metering gate means disposed between said supply port and distributing ports; and a pressure regulator whereby the difference between the supply pressure of fuel being supplied to said supply port and the negative pressure in the suction pipe of an internal combustion engine into which a predtermined amount of fuel metered by said fuel metering gate means is injected is maintained constant, the arrangement being such that the amount of communication of said fuel metering gate means is controlled by engine rpm and the amount of suction air.

FEATURES OF THE INVENTION

An object of the invention is to provide a fuel injection device which controls pressure drop at the fuel metering gate means, thereby improving the fuel metering accuracy.

Another object of the invention is to provide a fuel injection device designed so that even if the response of a pressure regulator for controlling pressure loss at the fuel metering gate means is not quick, this does not matter in practice.

A further object of the invention is to provide a fuel injection device having a compensation mechanism for compensating pressure loss at the fuel metering gate means in response to variations in fuel temperature.

BRIEF DESCRIPTION OF THE DRAWINGS

FIG. 2 is a section taken along the line II—II of FIG. 1;

FIGS. 3*a* and 3*b* are enlarged plan views of cavities;

FIG. 4 is a developed view of the opening areas of rectangular cavities formed in the inner peripheral surface of a body shown in FIG. 1;

DESCRIPTION OF THE PREFERRED EMBODIMENTS

Figure 1:
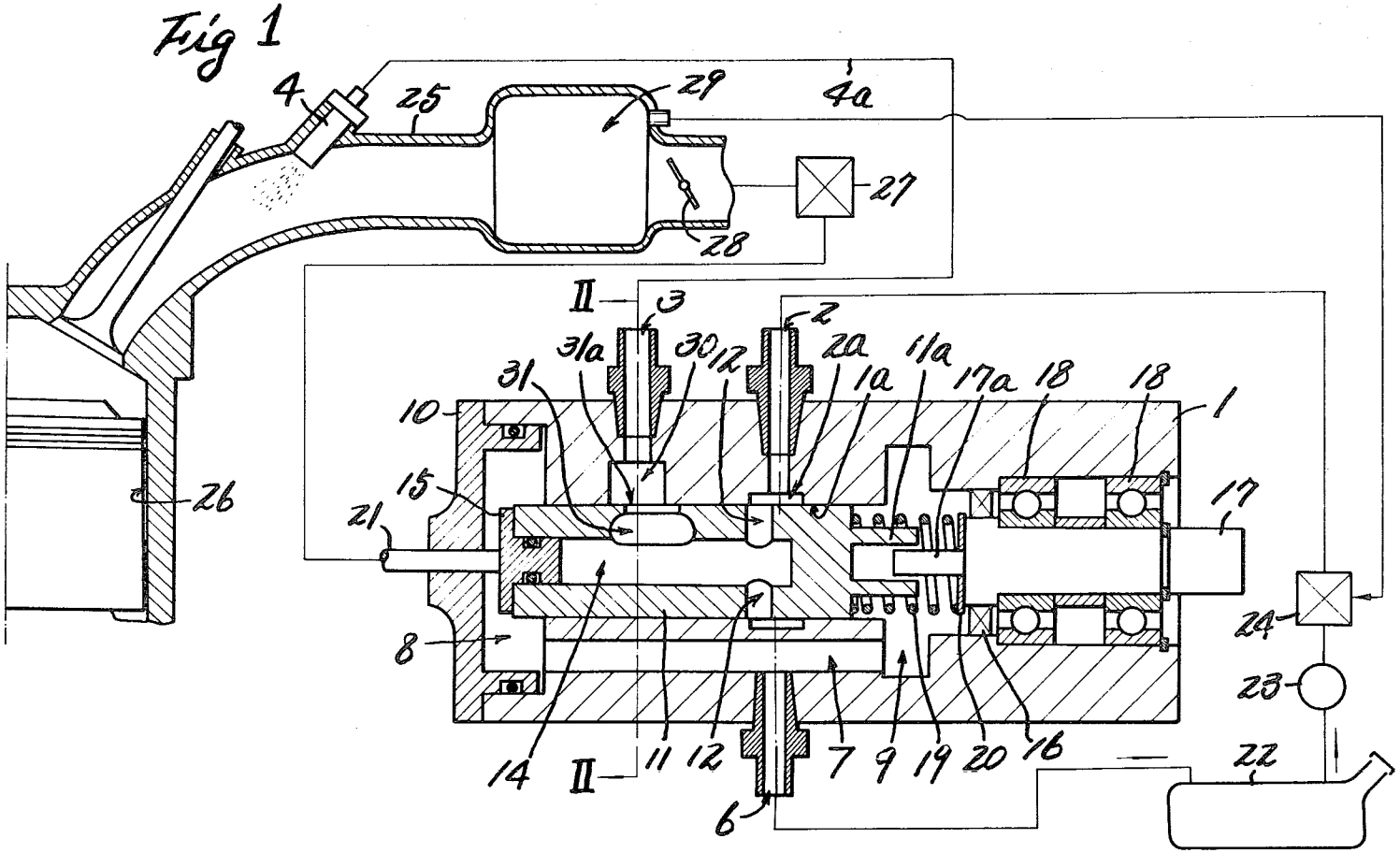
FIG. 1 is a longitudinal section showing the basic device of the invention applied to a 4-cycle 4-cylinder engine.

Referring to FIG. 1, the numeral 1 designates a cylindrical body; 2, an oil supply port communicating with an annular cavity 2*a*; 3, discharge ports each connected to an injector 4 provided in the suction pipe 25 of a cylinder 26 of an engine through a line 4*a*. The injector 4 is constructed so that when the pressure in the pipe line 4*a* reaches a predetermined value, its valve will be opened to inject fuel. Each discharge port 3 internally communicates with a cavity 30 whose surface 30*a* which opens to the inner peripheral surface of the body 1 is a square or rectangle with two sides extending parallel with the axis, as shown in FIG. 3*a*. The number of cavities 30 and of discharge ports 3 is the same as the number of cylinders of the engine and in the case of a 4-cylinder engine, they will be substantially equispaced in a row on the circumference, as shown in FIG. 2. A drain port 6 communicates with cavities 8 and 9 through an axial hole 7. Designated at 10 is a lid cooperating with the main body 1 to define the cavity 8. Designated at 11 is a rotor fitted on the inner peripheral surface 1*a* of the body 1. The rotor 11 is formed with fuel inlets 12 and an outlet 31, said inlets and outlet communicating with each other through a cavity 14. The fuel inlets 12 communicate with a fuel supply annular cavity 2*a* in the body 1. The outlet 31 is provided with a slit 31*a* serving as a distributing port disposed at a position such that when the rotor 11 is rotating, the slit 31*a* opens successively to the four cavities 30 formed in the body 1. In this connection, it is to be noted that the rotor may be provided with cavities while providing the body with a slit or orifice. In the fuel injection device, the clearance between the cavity 2*a* of the body 1 and the rotor 11 is lubricated with gasoline, and it has been experimentally found that if the operating clearance of the rotor 11 is greater than $2\mu$ and smaller than the larger of the two, $7\mu$ and 1/3,000 of the diameter of the rotor 11, then normal and smooth rotation can be achieved. Designated at 15 is a lid for defining the cavity 14 in the rotor 11. Designated at 16 is a seal for preventing leakage of fuel. A shaft 17 for driving the rotor 11 is supported in bearings 18. Designated at 11*a* and 17*a* are members or portions of such members fixed to the rotor 11 and shaft 17, respectively, for transmitting rotation from the shaft 17 to the rotor 11 and they cooperate with each other to constitute an axially slidable coupling. The numeral 19 designates a spring and 20 designates a spring seat. A control rod at 21 is slidable right and left in operative association with the output of a meter 27 for metering the amount of air being sucked into the engine. The rotor 11 is urged against the control rod 21 by the spring 19, so that its axial position will change with the movement of the control rod 21. In this case, since communication between the opposite ends of the rotor is established by the drain port 6, no pressure difference is produced thereacross. Therefore, the rotor 11 can be smoothly slid even by a very small amount of force. The numeral 22 designates a fuel tank and 23 designates a pump for feeding fuel under pressure. The pump 23 may be of the type electrically driven from a battery or it may be mechanically driven by the engine. In the case of the latter type, it may be assembled with the body 1 in place of the shaft 17 and bearings 18. Designated at 24 is a pressure regulator whereby the difference between fuel supply pressure and discharge pressure is maintained constant. The numeral 28 designates a throttle valve for adjusting the amount of air being sucked into a cylinder 26, and 29 designates a cavity for distributing air to the suction manifolds.

The body 1 is mounted on the engine by a suitable attachment (not shown) and the shaft 17 is driven at precisely half the speed of the crank shaft by using a suitable power transmission mechanism such as toothed belts and gear wheels (not shown).

Fuel is pumped up by the pump 23 from the fuel tank 22, pressurized and fed into the oil supply port 2 through the pressure regulator 24. The fuel fed into the oil supply port 2 is then fed into the cavity 14 through the annular cavity 2*a* and fuel inlets 12 of the rotor 11. When the rotor 11 is rotating, the slit 31*a* is circumferentially moved along the opening surfaces 30*a* of the cavities 30. Thus, in FIG. 3*a*, the slit is moved in the direction A→B, and at a position A, the slit 31*a* begins to open to the cavity 30 and it closes at a position B. During the time the slit 31*a* opens to the cavity 30, the fuel flows out of the cavity 14 into the cavity 30 at a constant rate of flow via the outlet 31 and slit 31*a* and then flows through the line 4*a* into the injector 4, from which it is injected into the suction pipe 25 of the engine. The injection of fuel is performed in synchronism with the suction cycle of the engine.

In FIG. 3*a*, since the circumferential length m of the opening surface of the cavity 30 is constant, the opening time of the slit 31*a* is inversely proportional to the rpm of the rotor 11. On the other hand, the length s of the opening of the slit 31*a* is proportional to the amount of air being sucked into the cylinder 26. Thus, when the throttle valve 28 is fully open and the engine is operating at its maximum rmp, the length s is greatest and it is smallest when the throttle valve 26 is completely closed and the engine rpm is lowest (i.e., when in idling condition). Therefore, the rate of flow of fuel passing through the slit 31*a* is proportional to the opening length s of the slit 31*a* and hence the amount of injection at a time is proportional to (amount of suction air per unit time)/(rpm). In brief, the mixing ratio of air sucked into the cylinder and fuel is maintained constant.

The opening surfaces 30*a* of the cavities may have the same circumferential length m if the amounts of fuel to be fed to all cylinders are the same. If, however, the amount of fuel to be fed must be varied from cylinder to cylinder, said length m may be varied. For example, in the case of a 4-cylinder engine, if it is necessary to feed thick mixed gas to two cylinders and thin mixed gas to the other two and burn said thick and thin gases alternately, then a developed view of the opening surfaces 30*a* of the cavities 30 of the body 1 may be as shown in FIG. 4.

FIG. 3*b* shows another form of fuel metering gate means, wherein the opening surface 30*a* of a cavity 30 leading to a discharge port 3 is shaped substantially into a triangle with one side thereof circumferentially extending and an orifice 31*a* is provided as a distributing port to be provided in the outlet 31 of the rotor 11. Since the rotor 11 is constructed in the manner described above, when it is rotated, the orifice 31*a* is circumferentially moved over the triangular cavity 30. Thus, in FIG. 3*b*, the orifice 31*a* is moved in the direction A→B. At point A, the orifice 31*a* beins to open to the cavity 30 and it closes at point B. The supply of fuel is controlled in connection with the rpm and axial displacement of the rotor 11.

In the above description, the fuel injection device of the invention has been described with reference to a case where it is applied to a 4-cycle 4-cylinder engine, but the device is also applicable to engines having less or more cylinders and to 2-cycle engines.

Figure 5:
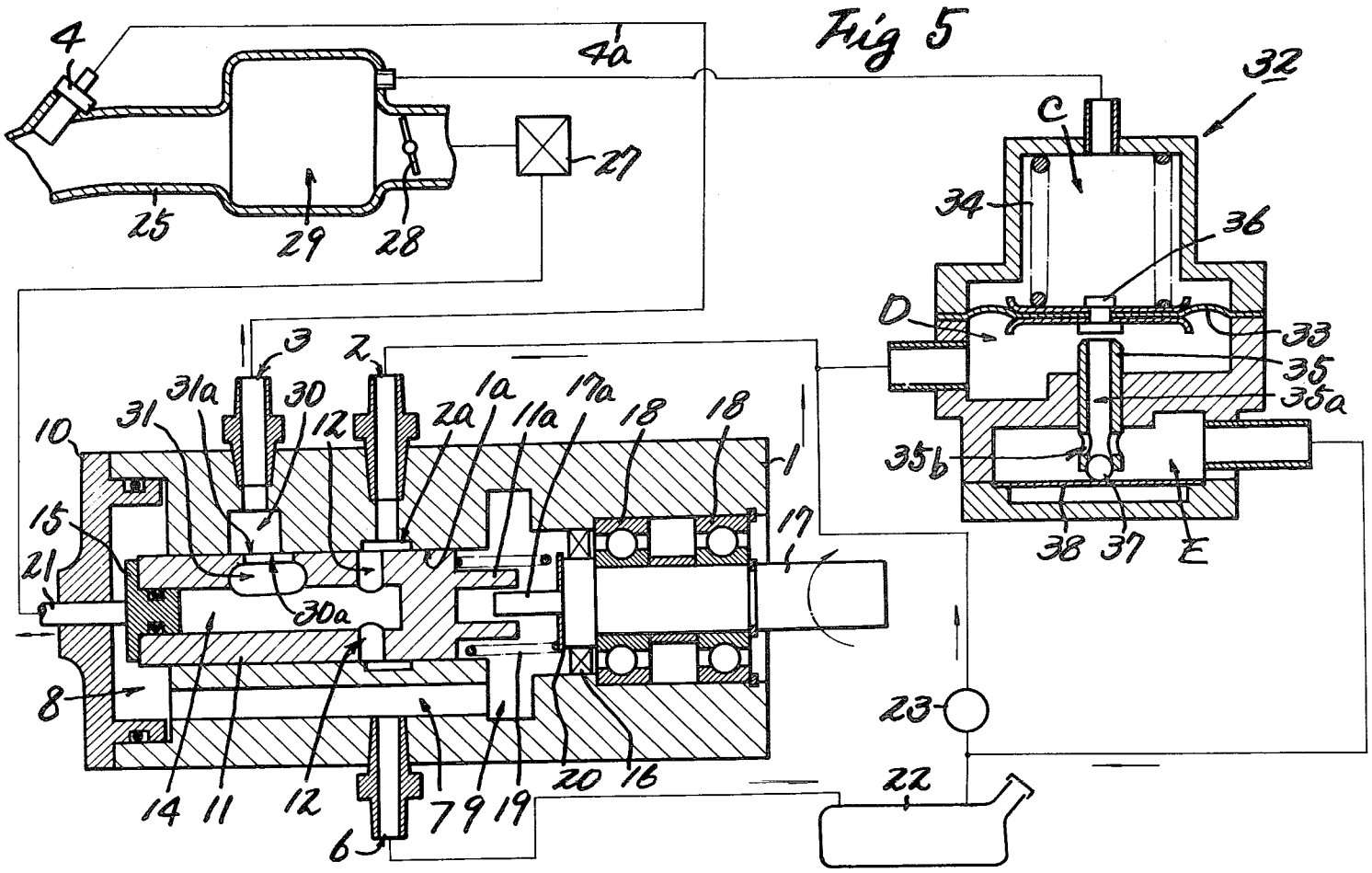
FIG. 5 is a longitudinal section of the device of the invention incorporating a compensation mechanism.

FIG. 5 shows said fuel injection device incorporating a pressure regulator having a compensation mechanism adapted to respond to fuel temperature variations so as to maintain constant the difference between fuel supply pressure and suction pipe negative pressure to improve the accuracy of the amount of fuel to be injected. This will now be described in more detail with reference to FIG. 5.

In FIG. 5, a pressure regulator 32 comprises an upper chamber divided into two chambers C and D by a diaphragm 33, and a lower chamber E, said chamber C containing a compression spring 34 urging the diaphragm 33 and communicating with the negative pressure chamber 29 in the suction pipe. The chamber D is connected between the fuel pump 23 and the oil supply port 2. The chamber E has a vertically movable pressure regulating valve 35 extending into the chamber D and is connected between the fuel tank 22 and the fuel pump 23. The pressure regulating valve 35 has communication holes 35*a* and 35*b* and cooperates with a flat-seat valve 36 mounted in the diaphragm 33 to form a valve mechanism. A ball 37 is held in the lower end of the pressure regulator 35 and is contacted with a bimetallic strip 38. The suction pipe negative pressure in this pressure regulator 32 acts on the diaphragm 33 through the chamber C, while fuel passes through the fuel pump 23 and chamber D and acts on the diaphragm 33. It flows into the chamber E through the pressure regulating valve 35 and is fed back to the fuel tank 22. In addition, the force exerted on the diaphragm 33 by the fuel pressure on the delivery side of the fuel pump 23, i.e. the pressure in the chamber E, is balanced by the force exerted by the sum of the force of the comprssion spring 34 and the suction pipe negative pressure. In other words, the difference between the fuel pressure and the suction pipe negative pressure is compensated by the deflection of the compression spring 34.

In this connection, it is to be noted that in this type of fuel injector, for example, if the fuel supply pressure is made constant irrespective of the suction pipe negative pressure, then, since the valve opening pressure for the injector 4, which is of the relief valve type, is equal to the difference between the suction pipe negative pressure and the pressure in the line 4*a*, the amount of fuel injected from the injector 4 is influenced by the suction pipe negative pressure. This results in lowering accuracy of the amount of injection of fuel metered by the opening length s of the slit 31*a*. Further, the amount (weight) of injection of fuel is proportional to the root of the product of the pressure difference across the slit 31*a* and the specific weight of fuel. Therefore, if the specific weight varies with fuel temperature, the amount of injection will vary, though slightly. Further, in cases where a plastic tube is used as the line 4*a*, the elastic modulus of the material varies with fuel temperature and hence the back pressure in the line 4*a* varies, so that the amount of injection varies accordingly.

In contrast thereto, the fuel injection device of the invention is provided with the above described countermeasure, namely, the pressure regulator 32 intended to improved the accuracy of the amount of injection of fuel.

In FIG. 5, if the suction pipe negative pressure increases, the meter 27 which meters the amount of suction air moves the control rod 21 to the left, thereby increasing the opening length s of the slit 31*a*. As a result, the amount of injection of fuel becomes equal to the product of the pressure difference across the slit 31*a* and the sum of the opening length s and the amount of variation thereof. If the pressure difference across the slit 31*a*, i.e. the difference between the suction pipe negative pressure and the fuel supply pressure is maintained at a predtermined value, then the amount of injection of fuel can be used to calculate a desired air-fuel ratio corresponding to the amount of suction air. The pressure difference across the slit 31*a* is controlled in the following manner.

As the suction pipe negative pressure increases, the negative pressure in the chamber C of the pressure regulator 32 increases, so that the diaphragm 33 is drawn upward against the force of the compression spring 34, thereby increasing the amount of inflow of fuel provided by the valve mechanism constituted by the flat-seat valve 38 and pressure regulating valve 35. As a result, the portion of the fuel pressurized by the fuel pump 23 which is fed back from the chamber D to the fuel tank 22 via the pressure regulating valve 35 and chamber E increases in amount. In brief, the pressure of the fuel being supplied to the oil supply port 2 is decreased. This decrease in the supply pressure is equal to the amount of variation in the position of the diaphragm 33 and to the amount of increase in the suction pipe negative pressure. On the other hand, the pressure in the discharge port 3 and hence in the cavity 30 is influenced by the suction pipe negative pressure at the time of opening the valve of the injector 4 and the negative pressure increases by an amount corresponding to the amount of increase in the suction pipe negative pressure. However, since the fuel supply pressure (the pressure in the oil supply port 2 and hence in the cavity 14) is decreased by an amount corresponding to the amount of increase in the suction pipe negative pressure, as described above, the net result is that the pressure difference across the slit 31*a* remains unchanged. Therefore, the amount of injection of fuel is uniquely determined by the opening length s of the slit 31*a*.

Further, the pressure regulating valve 35 of the pressure regulator 32 is vertically moved by the bimetallic strip 38 to vary the area of the opening defined between it and flat-seat valve 36. The bimetallic strip 38 expands or contracts according to variations in the temperature of the fuel flowing through the chamber E, in such a manner that when the temperature rises, it bends upward. When the bimetallic strip 38 bends as described, the pressure regulating valve 36 is moved upward through the ball 37 to decrease the area of said opening, thereby restricting the rate of flow of fuel therethrough while increasing the rate of flow of fuel being supplied to the oil supply port 2 and also increasing the supply pressure. As a result, the pressure difference across the slit 31*a* increases by an amount corresponding to the decrease in the amount of injection of fuel which varies with the specific weight of fuel, i.e. with fuel temperature variations, and it is compensated.

Figure 6:
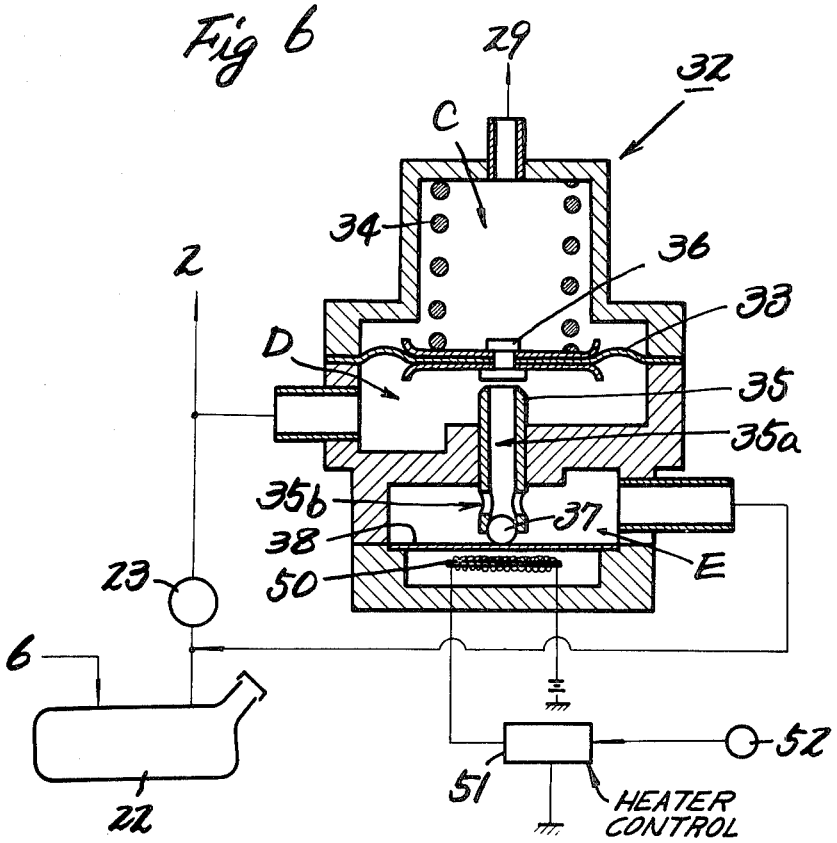
FIGS. 6 and 7 are longitudinal sections showing other forms of the compensation mechanism.

FIG. 6 shows another form of pressure regulator. For example, as in quick acceleration or warming up, there are cases where it becomes necessary to temporarily vary the air/fuel mixing ratio so as to give more fuel. This can be easily achieved by using a throttle position sensor, a cooling water temperature sensor, an exhaust gas sensor, such as an oxygen concentration sensor, to temporarily displace the bimetallic strip so as to increase the fuel supply pressure.

Designated at 50 is a heater, the energization of which is controlled by a control 51. The control 51 is a heater, the energization of which is controlled by a signal from a sensor 52. The control 51 is actuated by a signal from the sensor 52. As the sensor 52, said throttle position sensor, cooling water temperature sensor and/or exhaust gas sensor is used.

In the required situation of sensor 52, the control 51 holds the heater 50 in energized condition, with the bimetallic strip 38 upwardly displaced to lift the pressure regulating valve 35 to decrease the area of the opening defined by the latter and the flat-seat valve 36, thereby increasing the fuel supply pressure. This operation is maintained so long as the sensor 52 is in the predetermined situation.

When the output from the sensor 52 is shifted from the required value, the heater 50 is deenergized, allowing the bimetallic strip 38 to be restored to its normal condition.

As is clear from the above, the accuracy of the amount of injection of fuel achieved by the present invention is greately improved as compared with the prior art. In addition, the above refers to a case where the suction pipe negative pressure is increased, but it is to be understood that the reverse case will also provide the same results.

Figure 7:
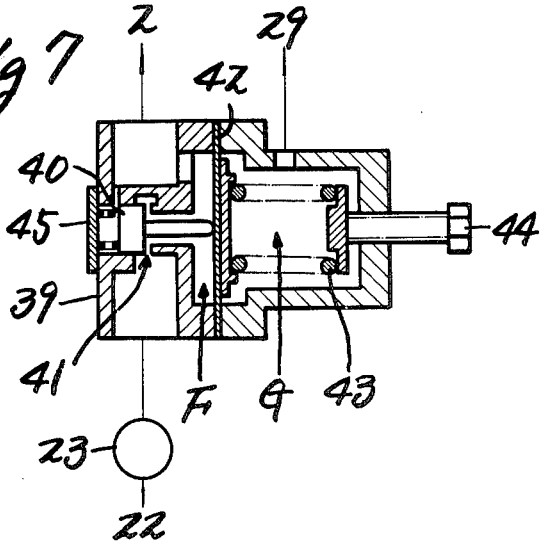

FIG. 7 shows a further form of pressure regulator, which is of the plunger type. Oil from the oil pump 23 is passed through an orifice 41 defined by a body 39 and a plunger 40 and enters a chamber F where it acts on a diaphragm 42, and then it is supplied to the oil supply port 2. On the other hand, the suction pipe negative pressure enters a chamber G and acts on the diaphragm 42 against the force of a compression spring 43. Designated at 44 is a member for fine adjustment of the compression spring 43, and 45 is a bimetallic strip. The fuel supply pressure in this embodiment is controlled in a way different from that in the preceding embodiment. Thus, the diaphragm 42 is displaced according to variations in the suction pipe negative pressure, so as to move the plunger 40, thereby directly controlling the rate of flow of fuel passing through the orifice 41. However, the same results as in FIG. 5 will be obtained.

Whiles there have been described herein what are at present considered preferred embodiments of the several features of the invention, it will be obvious to those skilled in the art that modifications and changes may be made without departing from the essence of the invention.

It is therefore to be understood that the exemplary embodiments thereof are illustrative and not restrictive of the invention, the scope of which is defined in the appended claims and that all modifications that come within the meaning and range of equivalency of the claims are intended to be included therein.

We claims

1. A fuel injection device for an internal combustion engine having an intake suction pipe including a fuel distributing mechanism comprising:

a body having:

a fuel supply port;

a plurality of discharge ports supplying injectors which inject fuel into said suction pipe of said internal combustion engine; and fuel metering ports communicating with said discharge ports; a rotor comprising:

a fuel inlet always communicating with said supply port; and at least one fuel distributing port communicating with said fuel inlet and cooperating with said fuel metering ports to form fuel metering gate means; said rotor being axially slidably and rotatably disposed in said body;

driving means for driving said rotor in synchronism with the rotation of the engine; and control means for axially sliding said rotor corresponding to the amount of suction air; the arrangement being such that the amount of communication of said fuel metering gate means is controlled by engine rpm and the amount of suction air, wherein a pressure regulator communicates with said supply port and said suction pipe so that the difference between the supply pressure of fuel being supplied to said supply port and the negative pressure in said suction pipe is maintained at a predetermined value.

2. A fuel injection device as set forth in claim 1 wherein the pressure regulator comprises:

two chambers separated by a diaphragm;

a valve mechanism cooperating with said diaphragm to vary the area of an opening defined therebetween; and a pressure difference-setting spring wherein the fuel supply pressure acts in one of said chambers, while the negative pressure in the suction pipe acts in the other chamber.

3. A fuel injection device as set forth in claim 2 wherein the valve mechanism comprises:

a valve seat member fixed in the movable portion of the diaphragm; and a valve member cooperating with said valve seat member.

4. A fuel injection device as set forth in claim 3 wherein the pressure regulator includes:

a compensating mechanism corresponding to a temperature of the fuel being supplied; whereby the area of the opening of the valve mechanism is varied so that the predetermined pressure difference in said pressure regulator is compensated in accordance with the temperature of the fuel being supplied.

5. A fuel injection device as set forth in claim 4 wherein the compensating mechanism comprises:

a bimetallic strip disposed in the chamber of the pressure regulator in which the fuel supply pressure acts and expands or contracts in accordance with variations in the temperature of the fuel.

6. A fuel injection device as set forth in claim 1 wherein the fuel metering gate means comprises:

a substantially triangular window whose one side extends circumferentially of the rotor; and a small hole or orifice.

7. A fuel injection device as set forth in claim 1 wherein the fuel metering gate means comprises:

a substantially rectangular window whose two sides extend circumferentially of the rotor; and an axially extending slit.

* * * * *